United States Patent [19]

Nilsen

[11] Patent Number: 4,858,692

[45] Date of Patent: Aug. 22, 1989

[54] CEMENTING APPARATUS AND METHOD FOR EXECUTION OF CEMENTING OPERATION

[75] Inventor: Magne P. Nilsen, Hafrsfjord, Norway

[73] Assignee: Den norske stats oljeselskap a.s, Norway

[21] Appl. No.: 168,983

[22] Filed: Mar. 16, 1988

[30] Foreign Application Priority Data

Mar. 19, 1987 [NO] Norway ..... 871125

[51] Int. Cl.[4] ..... E21B 33/13

[52] U.S. Cl. ..... 166/285; 166/290; 166/70; 166/387; 166/321

[58] Field of Search ..... 166/285, 290, 380, 382, 166/387, 70, 319, 321, 323

[56] References Cited

U.S. PATENT DOCUMENTS 4,479,544 10/1984 Collihan et al. ..... 166/290

4,602,684 7/1986 Van Wormer et al. ..... 166/285

*Primary Examiner*—William P. Neuder

*Attorney, Agent, or Firm*—Lucas & Just

[57] ABSTRACT

Cementing apparatus to be used for well cementing operations comprising an intermediate casing (10) which features one or several cementing ports (12), a main tool (21) with one or several cementing channels (22) located with their outlets aligned with the cementing ports (12), a main sealing sleeve (13) and an auxiliary sleeve (17) that features one or several port openings (15, 19), the main sealing and pilot sleeves (13, 17) as a unit in an initial lower position closing the connection between the cementing channels (22) and the cementing ports (12), and forming the said connection in a second vertically shifted position through the port openings (15, 19). A procedure for execution of a cementing operation.

10 Claims, 4 Drawing Sheets

CEMENTING APPARATUS AND METHOD FOR EXECUTION OF CEMENTING OPERATION

Figure 1:
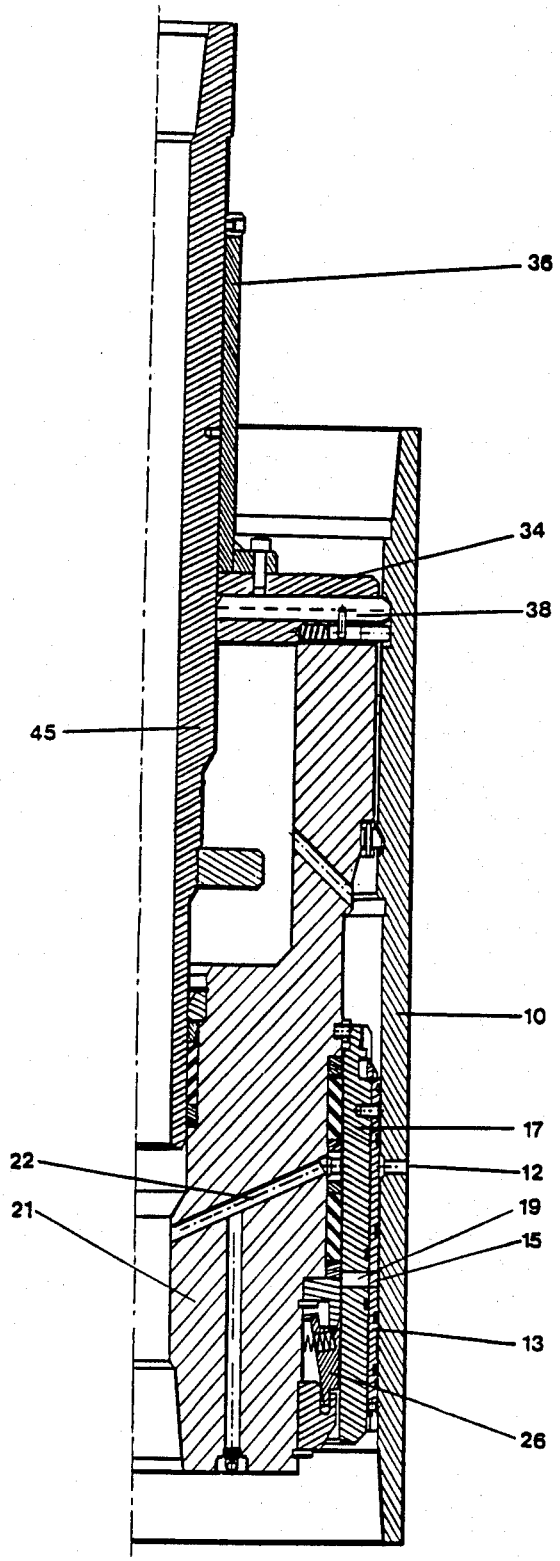

The present invention relates to a device consisting of a cementing apparatus to be used for well cementing operations. The invention also comprises a procedure for execution of the cementing operation.

The existing cementing apparatuses have proven to be impaired by substantial deficiencies and functional errors. The known structures have a complex design and are expensive in purchase and operation. Among other things, the opening and closing mechanisms of the known apparatuses are mechanically operable, and this has involved in part considerable problems.

One object of the present invention is to provide a cementing apparatus of a simple and reliable design, and where the apparatus opening mechanism can be hydraulically operated and its closing mechanism can be mechanically operated, or alternatively, where both the opening and closing mechanism are hydraulically operable.

This, according to the present invention, has been accomplished by a device and a procedure further explained that: the cementing apparatus for well cementing operations is characterized by comprising an intermediate casing (10) that features one or several cementing ports (12), a main tool (21) with one or several cementing channels (22) located with their outlets aligned with the cementing ports (12), a main sealing sleeve (13) and an auxiliary sleeve (17) that feature one or several port openings (15, 19), the main sealing and auxiliary sleeves (13, 17) as a unit in an initial lower position closing the connection between the cementing channels (22) and the cementing ports (12), and in a second vertically shifted position forming said connection through the port openings (15, 19); and the procedure for execution of cementing operations in wells is characterized by the steps of an intermediate casing (10) featuring a unit consisting of a main sealing sleeve (13) and an auxiliary sleeve (17) which in an initial position is axially shifted and seals the cementing ports (12) of the intermediate casing (10); the intermediate casing (10) with main sealing and auxiliary sleeves (13, 17) is clamped between two casings and lowered down in the well in the desired place; the main tool (21), through which an intermediate tubing (45) is suspended from the drill pipe, until a locking ring (32) on the main tool (21) enters into engagement with a slot (33) in the intermediate casing (10); a fluid-tight barrier is established between the internal room of the intermediate tubing (45) and the annulus between the drill pipe and the casing by a further downturned vertical force being exerted on said drill pipe and the attached intermediate tubing (45) whereby the mounting pins (51), which represent a rigid connection between the intermediate tubing (45) and the main tool (21) are cut and said intermediate tubing (45) is run somewhat further down until the intermediate tubing (45) abuts against a protrusion (45), and the lower portion of the intermediate tubing (45) forms a sealing engagement with said main tool (21); a fluid pressure is applied through the drill pipe, and the drop in pressure over the unit consisting of the main sealing sleeve (13) and the auxiliary sleeve (17) effects the shearing of the mounting pins (14, 31), and said unit (13, 17) is brought vertically upward and stopped in a second position where the ports of said unit (13, 17) form a connection between the cementing channels (22) and the cementing ports (12), and said auxiliary sleeve is prevented from further upward movement by a shoulder (54) and is prevented from downward movement by latch pins (26); and cement is pumped through the drill pipe, the cementing channels (12), the ports (19) of the auxiliary sleeves, the ports (15) of the main sealing sleeve, and the cementing channels (12) of the intermediate tubing (10) and out into the annulus between the casing and the well wall.

In the following, the invention will be further described with reference to the accompanying drawings, whereof:

FIG. 1 is a schematic view of one half of the cementing apparatus

Figure 2:
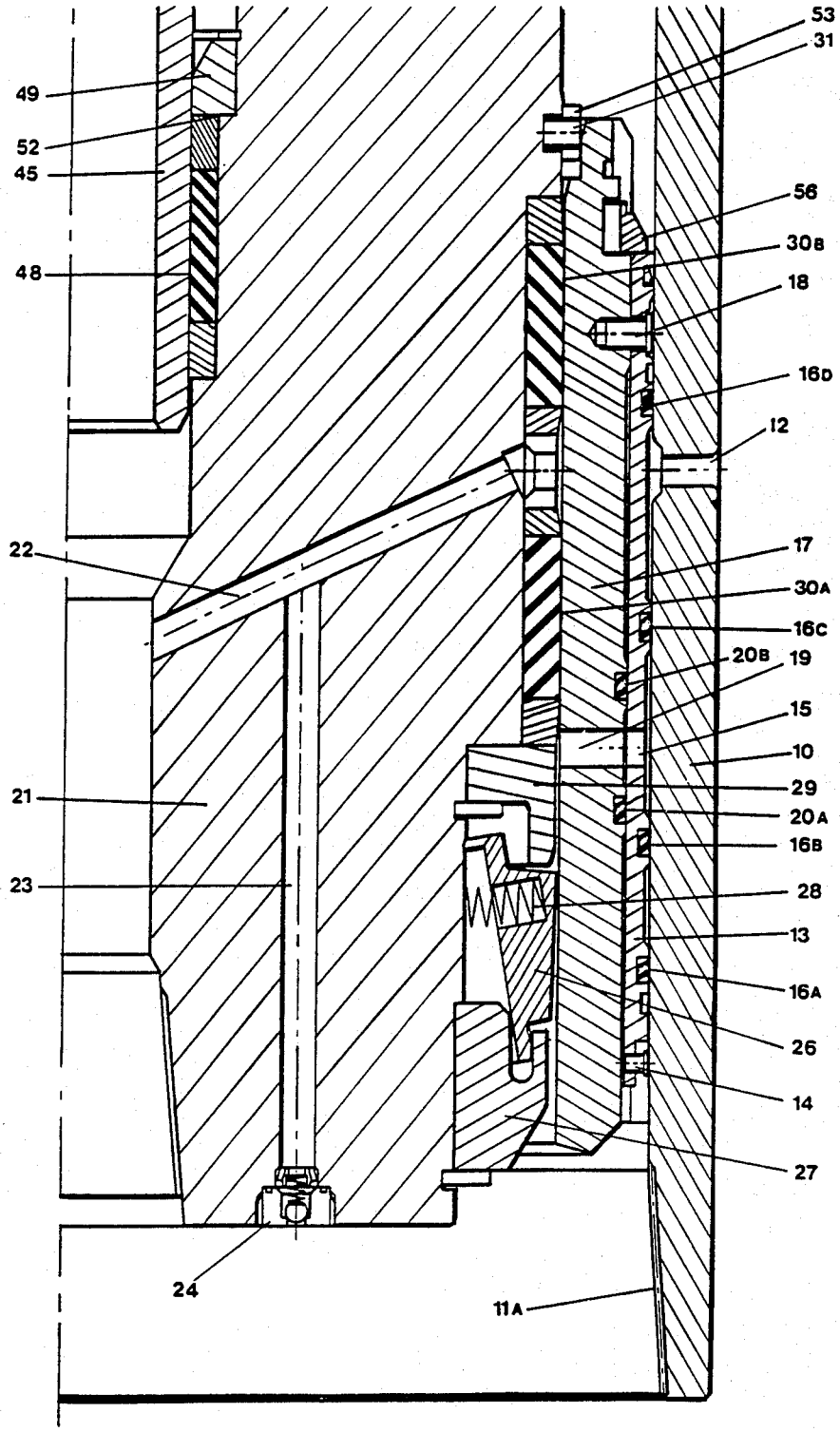
Figure 3:
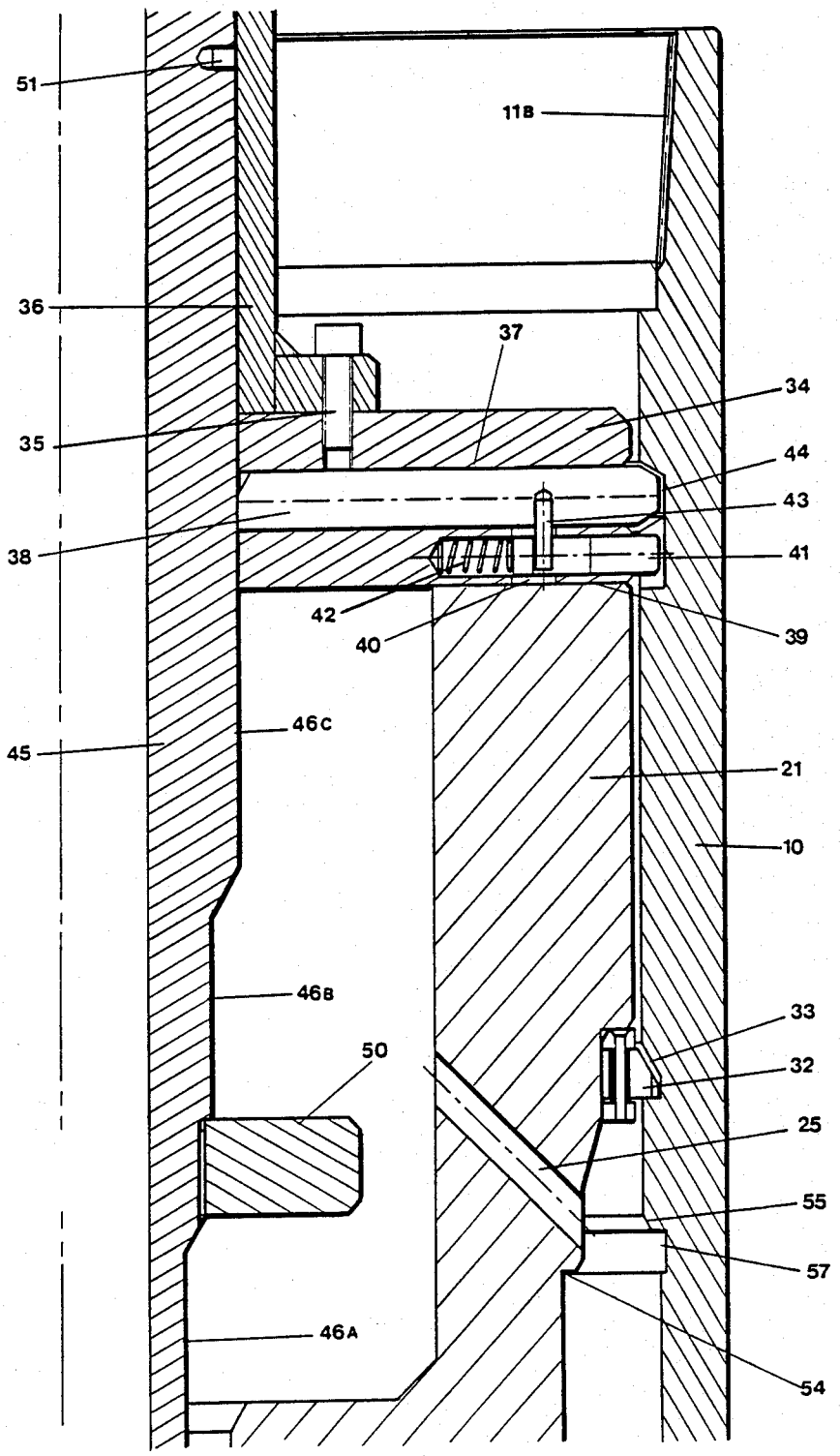
Figure 4:
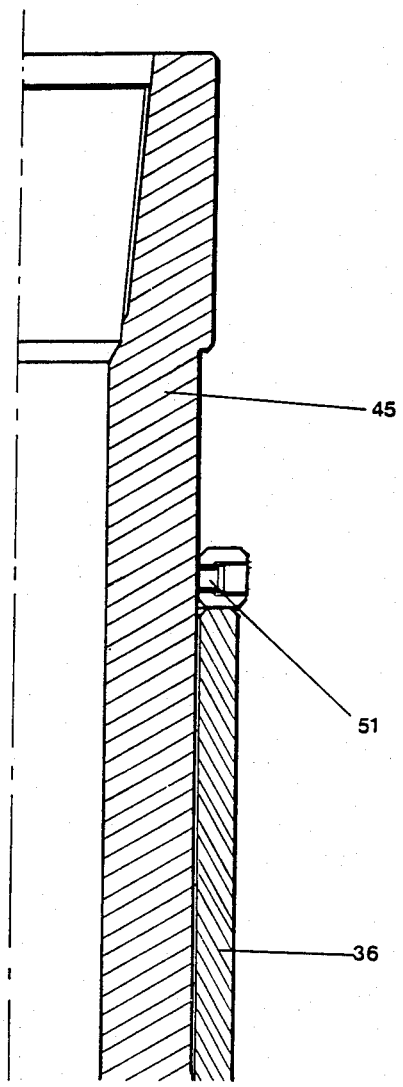

FIG. 2 shows the lower portion of the cementing apparatus on FIG. 1 on a larger scale FIG. 3 shows a second portion of the cementing apparatus on FIG. 1 on a larger scale from below, and FIG. 4 shows the upper portion of the cementing apparatus on FIG. 1 on a larger scale. de The outer part of the cementing apparatus, which on FIG. 1 is shown in an assembled condition, comprises an intermediate casing 10. The intermediate casing 10 may be mounted between casings in the desired place of the well by the said casings being screwed onto sleeves at each end of the intermediate casing 10, as these feature internal threads 11*a*, 11*b*. The intermediate casing 10 is introduced into the well together with the adjacent casings, and comprises one or preferably several cementing ports 12.

The main sealing sleeve 13 is in an initial, lower position secured to the inside of the intermediate casing 10 with a plurality of mounting pins 14, and features one or preferably several port openings 15. Several sealing joints 16*a*–16*d*, preferably in the form of O-rings, have been installed between the main sealing sleeve 13 and the intermediate casing 10. An auxiliary sleeve 17 has been attached internally in the main sealing sleeve 13. The auxiliary sleeve 17 comprises one or preferably several port openings 19. The auxiliary sleeve 17 and the main sealing sleeve 13 form a tight engagement by the packer seal units 21*a*, 20*b* being placed between them.

A main tool 21, sliding mounted inside of the auxiliary sleeve 17, features cementing channels 22, a lower bleeding channel 23 with a check valve 24 and an upper bleeding channel 25. One or several latch pins 26 are installed in a reduced diameter section on the lower end of the main tool's external side surface. Each latch pin 26 is pivotally supported in a slot on a lower guide block 27, and the latch pin 26 is radially outwardly tightened under influence from a spring 28. The radial pivoting of the latch pin 26 is restricted by a stopper 29. Two broad seal joints 30*a*, 30*b*, preferably made of rubber, have been mounted on the radial external side of the main tool 21, and are located on the upper and lower side respectively of the opening to the cementing channels 22. The seal joints 30*a*, 30*b* define a fluid-tight engagement between the main tool 21 and the auxiliary sleeve 17.

Mounting pins 31 have been installed on the radial exterior of the main tool right above the seal joint 30*b*. A clamped locking ring 32 is located right above the upper bleeding channel 25 designed with a partly inclined external surface and which can be brought into engagement with an approximately similar slot 33 on the inside of the intermediate casing 10.

The upper surface of the main tool 21 is permanently attached to a flange 34. The flange 34 is attached to a sleeve 36 by means of a screw joint (35). Several through-flowing radial openings 37 have been drilled in the flange 34, in which latch pins 38 have been installed. A parallel bore 39 protruding somewhat into the flange 34, for example a length corresponding to half that of the flange breadth, has been installed on the lower side of each opening 37. Between each opening 37 and associated bore 39, an axially running connecting opening 40 has been provided, preferably located at the mid-portion of the seal joint 39. A movable piston 41, which is radially outwardly tightened by a spring 42, is mounted in the bore. A binding bolt 43 runs axially through the connecting opening 40 and forms a rigid connection between each latch pin 38 and associated piston 41. A cavity 44 has been milled in the intermediate casing 10 in which the latch pins 38 can be engaged.

On the inside of the main tool 21, an intermediate tubing 45 has been mounted, on top of which is provided a threaded socket that may be screwed onto a drill pipe (not shown). The internal surface of the intermediate tubing will run parallel with the internal surface of a drill pipe located above. The external surface of the intermediate tubing comprises a lower graduation **46*a*, a middle graduation 46*b*, and an upper graduation 46*c*. A seal joint 48 and a stop ring 49 have been mounted on the lower-end reduction 46*a*. A carrier 50 has been attached to the middle reduction 46*b***.

Further details concerning the cementing apparatus will be described in the subsequent description of the manner of operation of the apparatus.

Prior to a planned cementing operation, the intermediate casing 10 is clamped between two casings as explained above and located in a desired position in the well. The main sealing sleeve 13 is attached to the inside of the intermediate casing 10 by the mounting pins 14 and auxiliary sleeve 17 being attached to the inside of the main sealing sleeve 13 with the shear pins 18. The intermediate casing 10 with the main sealing sleeve 13 and the auxiliary sleeve 17 is lowered down in the well together with the other casings.

As described above, the intermediate tubing 45 is attached to the end of a drill pipe by means of a threaded joint. The main tool 21, which is attached to the flange 34, which in its turn is attached to the sleeve 36 through the screw joint 35, is rigidly connected to the intermediate tubing 45 by means of mounting pins 51.

Prior to the cementing operation, the main tool 21, suspended from the drill pipe through the intermediate tubing 45, is introduced into the casing. The bleeding channels 23, 25 prevent the build-up of pressure underneath the main tool 21 during said introduction. The main tool will not stop until the locking ring 32 is brought into engagement with the slot 33 on the intermediate casing 10. The main tool 21 is now prevented from further vertical movement downward in the well and the external openings of the cementing channels are located right across the external port openings 12 of the intermediate casing. Additional downward vertical force is subsequently exerted on the intermediate tubing 45, effecting the cutting of the mounting pins 51, and the intermediate tubing 45 is run somewhat further down the well until the stop ring 49 of the intermediate tubing 45 is brought to bear against a protrusion 52 on the main tool 21. The sealing joint 48 will now be squeezed between the lower reduction **46*a* of the intermediate tubing 45 and the main tool 21**. Thus, there will no longer exist any connection between the room inside the drill pipe and the annulus between the drill pipe and the casing. This stage of the cementing operation is also illustrated on the enclosed figures.

However, connection has still not been established between the drill pipe and the annulus between the casing and the well wall to be cemented. The reason being that the port openings 15, 19 of the main sealing sleeve 13 and the auxiliary sleeve 17 in an initial position are axially shifted relative to the cementing channels 22 of the main tool 21 and the port openings 15 of the intermediate casing 10.

By applying a fluid pressure through the drill pipe, a drop in pressure will be produced over the main sealing sleeve 13 and auxiliary sleeve 17, effecting the mounting pins 14, 31 to be cut and the main sealing and auxiliary sleeves 13, 17 to be brought vertically upward until the upper portion of the auxiliary sleeve 17 through a ring 53 which is attached to the remnants of the latch pins 31 is brought to bear against a shoulder 54 on the main tool 21. The latch pin 26 will now be forced radially outward by means of the springs 28 to bear against the lower side of the auxiliary sleeve 17. The shoulder 54 of the main tool 21 prevents the auxiliary sleeve 17 and the attached main sealing sleeve 13 from moving vertically upward and the latch pins 26 prevent the corresponding vertical downward movement. The port openings 15, 19 of the main sealing and auxiliary sleeves will now connect the cementing channels of the main tool 21 to the port openings 12 of the intermediate casing. Guide supports may be installed to ensure that the respective cementing channels/ports 22, 19, 15, 12 are aligned, but even if such guide supports have not been installed, cavities milled around each opening (cfr. FIG. 2) will ensure that the cement comes through the cementing channels/ports 22, 19, 15, 12.

The per se standard cementing operation can now be started by cement being pumped pumped down into the drill pipe and further through the cementing channels 22, port openings 19, 15 and the cementing ports 12 and out into the annulus between the casing and well wall. If it is desirable to limit the cementing to a certain section, this may be done in a per se standard way in that the upper and lower part of the annulus section are sealed by means of packer elements.

When the cementing operation is completed, the drill pipe and the connected intermediate tubing will be pulled a short distance upwards. Now, the middle reduction **46*b* will be located right across the pins 38, and due to the connection with the springs 42, these will be brought out of engagement with the cavity 44. The main tool 21 can now be pulled somewhat further up, until the main sealing sleeve 13 abuts against a shoulder 55 on the inside of the intermediate casing 10. A check ring 56 on top of the main sealing sleeve 13 will now slip into a slot 57 in the intermediate casing 10 and the main sealing sleeve 13 will be locked in this position. When additional tractive power is added to the intermediate casing 45 the shear pins 18 between the main sealing sleeve 13 and the auxiliary sleeve 17 are cut. The intermediate tubing 45 and the accompanying main tool 21 in addition to the auxiliary sleeve 17** may now be pulled out of the well. The main sealing sleeve will remain in the well and contribute to keeping the port openings of the intermediate casing closed.

The actual dismounting operation is described as a purely mechanical operation. However, it will be readily apparent to those skilled in the art that the operation alternatively may be done hydraulically by applying fluid pressure though the drill pipe, in the same way as prior to the cementing operation.

I claim:

1. Cementing apparatus to be used for well cementing operations, characterized by comprising an intermediate casing (10) that features one or several cementing ports (12), a main tool (21) with one or several cementing channels (22) located with their outlets aligned with the cementing ports (12), a main sealing sleeve (13) and an auxiliary sleeve (17) that feature one or several port openings (15, 19), the main sealing and auxiliary sleeves (13, 17) as a unit in an initial lower position closing a communication therebetween the cementing channels (22) and the cementing ports (12), and in a second vertically shifted position forming said communication through the port openings (15, 19).

2. Cementing apparatus according to claim 1, characterized by the main sealing sleeve (13) in the initial position being attached to the intermediate casing (10) by means of mounting pins (14) and the auxiliary sleeve (17) being attached to said main sealing device (13) by means of shear pins (18), the mounting pins (14) and mounting pins (31) between said auxiliary sleeve (17) and the main tool (21) being cut in the second position, and the main sealing and auxiliary sleeves (13, 17) as a unit bearing against a shoulder (54) on the main tool and being prevented from further vertical upward movement, and latch pins (26) installed on a reduced diameter part at the lower end of the main tool (21) being urged radially outward for engagement with the lower side of the auxiliary sleeve (17), thus preventing vertical downward movement.

3. Cementing apparatus according to claim 1, characterized by the upper surface of the main tool (21) being attached to a flange (34), which is attached to a sleeve (36) by means of a screw joint (35), the said sleeve (36) being attached to the intermediate tubing (45) prior to the cementing operation by means of mounting pins (51).

4. Cementing apparatus according to claim 1, characterized by the main tool (21) comprising a clamped locking ring (32) with an inclined external surface which through engagement with an approximately similar slot (33) on the inside of the intermediate casing (10) prevents said main tool (21) from further vertical movement downward in the well.

5. Cementing apparatus according to claim 1, characterized by the flange (34) comprising several through-flowing radial openings (37), in which pins (38) have been installed, said pins (38) being brought into engagement in a cavity (44) on the inside of the intermediate casing (10) by means of axially directed binding bolts (43) which run through the connecting openings (40) and are connected with the spring pistons (41), temporarily preventing the main tool (21) from upward movement.

6. Cementing apparatus according to claim 1, characterized by the exterior surface of the intermediate tubing (45) comprising three reductions (46*a*–46*c*), the lower reduction (46*a*) having the largest diameter, and the lower reduction (46*a*) featuring a sealing joint (48) and a stop ring (49) and the middle reduction (46*b*) comprising a carrier (59).

7. Cementing apparatus according to claim 1, characterized by the outside of the main sealing sleeve (19) toward the intermediate casing (10) featuring at least four stop rings (16*a*–16*d*), the outside of the auxiliary sleeve (17) toward said main sealing sleeve (13) featuring at least two packer seal units (20*a*, 20*b*), and the outside of the main tool (21) toward the auxiliary sleeve (17) featuring at least two packer seal units (30*a*, 30*b*).

8. Cementing apparatus according to claim 1, characterized by the main tool (21) comprising a lower bleeding channel (23) with a check valve (24) and an upper bleeding channel (25).

9. Procedure for execution of cementing operations in wells, characterized by the following steps:

providing an intermediate casing (10) featuring a unit consisting of a main sealing sleeve (13) and an auxiliary sleeve (17) which in an initial position is axially shifted and seals the cementing ports (12) of the intermediate casing (10), providing the intermediate casing (10) with main sealing and auxiliary sleeves (13, 17) is clamped between two casings and lowered down in the well in the desired place, providing the main tool (21), through which an intermediate tubing (45) is suspended from the drill pipe, until a locking ring (32) on the main tool (21) enters into engagement with a slot (33) in the intermediate casing (10), establishing a fluid-tight barrier between an internal room of the intermediate tubing (45) and the annulus between the drill pipe and the casing by a further downturned vertical force being exerted on said drill pipe and the attached intermediate tubing (45) whereby the mounting pins (51), which represent a rigid connection between the intermediate tubing (45) and the main tool (21) are cut and said intermediate tubing (45) is run somewhat further down until the intermediate tubing (45) abuts against a protrusion (45), and the lower portion of the intermediate tubing (45) forms a sealing engagement with said main tool (21), applying a fluid pressure through the drill pipe, and the drop in pressure over the unit consisting of the main sealing sleeve (13) and the auxiliary sleeve (17) effects the shearing of the mounting pins (14, 31), and said unit (13, 17) is brought vertically upward and stopped in a second position where the ports of said unit (13, 17) form a connection between the cementing channels (22) and the cementing ports (12), and said auxiliary sleeve is prevented from further upward movement by a shoulder (54) and is prevented from downward movement by latch pins (26), pumping cement through the drill pipe, the cementing channels (12), the ports (19) of the auxiliary sleeves, the ports (15) of the main sealing sleeve, and the cementing channels (12) of the intermediate tubing (10) and out into the annulus between the casing and the well wall.

10. Procedure for termination of the cementing operation according to claim 9, characterized by the following steps:

pulling the intermediate tubing (45) upward through the drill pipe, disengaging pins (38) from cavity (44) when the middle portion (46*b*) of the intermediate tubing (45) is positioned right across the pins (38), bringing carrier (50) of the intermediate tubing (45) to bear under flange (34) and pulling the main tool (21), the auxiliary sleeve (17) and the main sealing sleeve (13) upward until check ring (55) of said main sealing sleeve snaps into a slot (57) and locks the main sealing sleeve (13) to the intermediate tubing (10), cutting the shear pins (18) between the auxiliary sleeve (17) and the main sealing sleeve (13), pulling the drill pipe, carrying the intermediate tubing (45), the main tool (21) and the auxiliary sleeve (17), out of the well.

* * * * *